US005847300A

United States Patent [19]

Hackl

[11] Patent Number: 5,847,300

[45] Date of Patent: Dec. 8, 1998

[54] MOUTHPIECE SYSTEM FOR A TRUMPET OR OTHER BRASS INSTRUMENTS

[76] Inventor: Franz Hackl, 492 Humboldt St., Brooklyn, N.Y. 11222

[21] Appl. No.: 880,696

[22] Filed: Jun. 23, 1997

[51] Int. Cl.[6] ..... G10D 9/02

[52] U.S. Cl. ..... 84/398

[58] Field of Search ..... 84/398, 399

[56] References Cited

U.S. PATENT DOCUMENTS

| | | | |
|---|---|---|---|
| 3,191,483 | 6/1965 | Williams | 84/398 |
| 3,474,698 | 10/1969 | Anbo | 84/398 |
| 5,218,150 | 6/1993 | Pastnor | 84/398 |

*Primary Examiner*—William M. Shoop, Jr.
*Assistant Examiner*—Jeffrey W. Donels
*Attorney, Agent, or Firm*—Kane, Dalsimer, Sullivan, Kurucz, Levy, Eisele and Richard, LLP.

[57] ABSTRACT

The mouthpiece assembly includes an internal thread which engages an external thread of a leadpipe of a brass musical instrument. The internal thread can be placed on the stem of the mouthpiece or on an extension to the leadpipe into which the stem frictionally engages. In either case, the radial gap between the mouthpiece and the leadpipe is substantially eliminated. Additionally, the diameter of the air passageway can be configured to be substantially free of discontinuities. The various pieces of the mouthpiece assembly can be interchanged to vary some characteristics of the mouthpiece while keeping other characteristics constant.

17 Claims, 6 Drawing Sheets

MOUTHPIECE SYSTEM FOR A TRUMPET OR OTHER BRASS INSTRUMENTS

BACKGROUND OF THE INVENTION

1. Field of the Invention

This invention pertains to mouthpieces for trumpets or other brass instruments, particularly mouthpieces which have a smooth transition to the instrument and mouthpieces which are modular to allow for the interchanging of pieces to provide for varying certain qualities of the mouthpiece while maintaining other qualities.

2. Description of the Prior Art

Brass wind instruments have existed since ancient times. Their loud blasts have been used to banish evil spirits, summon deities, and inspire soldiers in battle. The sound is produced by causing a column of air enclosed in a pipe or cone to vibrate. Brass instruments can play only certain natural overtones of the fundamental pitch created by their vibrating air column. Because of their relative inflexibility, these instruments served mainly in supporting roles through the classical period of composition. Brass instruments were incapable of playing the entire chromatic range. The key trumpet, including four or five finger-operated keys that gave the instrument a full chromatic scale, was invented in Austria in the late Eighteenth Century. Hadyn and Hummel wrote concertos for the trumpet.

In 1820, a significant development was the development of valves and pistons for the trumpet. To increase the number of keys in which such instruments could play, extra length of tubing called crooks or shanks were provided, making possible the shift to a key other than that in which the instrument was built. Only after valves and pistons became common could the instruments move rapidly from one scale to another. The full melodic potential of this invention was not realized until late in the Nineteenth Century.

Since this time, brass instruments have played a primary role as a solo instrument in classical music, orchestral music, marching bands, contemporary music and the trumpet has been a principal jazz instrument since the days of Louis Armstrong.

In contrast to all other musical instruments, the musician is the source of the sound in a brass instrument, and the mouthpiece and the rest of the brass instrument assists in projecting the sound. In most if not all other musical instruments, the sound source is either a string (such as a piano or a guitar), reed (woodwind instruments), skin (a drum or other percussion instruments), etc. The sound source for a brass instrument is the lip of the human player. The lips have to be pressed against the mouthpiece to make it airtight. Air from the lungs build up air pressure in the mouth which forces the lips to open. As soon as the air is released, the air pressure reduces and the lips are able to go back to the closed position. This means, for example, if the concert pitch A (440 Hz) is played, the lips open and close 440 times a second. This produces a buzzing sound.

As previously discussed, a brass instrument consists of two main parts—the removable mouthpiece and the brass instrument itself. The mouthpiece is removable so that every musician can choose his or her individual mouthpiece. Every human being has different physical characteristics. The removable mouthpiece gives the musician the flexibility to change the mouthpiece according to his needs and/or the style of music that is required. However, this introduces a weak link into the instrument. A perfect link between the mouthpiece and the instrument is crucial. Particularly in the beginning, when the air column starts to vibrate, the resistance and intonation of the instrument are strongly influenced.

The differences between the brass instruments are in the length of the tubes (the longer the tube, the lower the pitch and the wider the tonal range), and in the bore. The bore is the relationship between length and width. Trumpets and trombones, for example, have a narrow bore in contrast to the wide bore of a flugelhorn or a baritone horn. Therefore, the sound of a flugelhorn is much warmer. Another major difference is in the leadpipes. A French Horn and a trumpet with piston valves have a conical leadpipe. Trombones and trumpets with rotary valves have a cylindrical leadpipe. The deficiency with all of them, but especially with conical leadpipes, is that the normal way of attaching the mouthpiece to the instruments is in fitting it into a conical shank which is the first part of the leadpipe.

The backbore of the mouthpiece is also conical to get a tight fit. As a result, there is always a gap in between the end of the mouthpiece and the actual beginning of the leadpipe where the cone or cylinder starts. There is a sudden change in diameter and a gap in length for the column of air. The passageway in a trumpet mouthpiece, for example, is typically between 3.5 and 4.0 millimeters in diameter while the leadpipe has a passageway typically between 11.2 and 12.0 millimeters in diameter. In the typical prior art configuration, if there were no gap between the mouthpiece and leadpipe, the mouthpiece would be loose.

Playing different styles of music requires different equipment. Playing in the "Big Band" style requires a free blowing instrument with very little resistance. However, in classical music or chamber music, more resistance is needed to make it easier to play at a much lower volume consistent with the volume of the string and woodwind instruments. Therefore, different leadpipes are built for different musical styles. However, a musician must change the mouthpiece as an integral unit with a new cup, rim and backbore. However, it is hard for a musician to get used to different equipment. The cup of the mouthpiece feels different. The airflow characteristics are different. The more variations a musician is confronted with, the more difficulties the musician will have controlling his playing, and the more difficulties the musician will have with accurate pitch, stable (that is, not shaky) notes, endurance, range, small/hard sound etc. Additionally, if a mouthpiece remains in a brass instrument for an extended period, the mouthpiece may fit so tightly that it can't be removed and it must be serviced by a professional. If one tries to force it out as most people do, the leadpipe may be destroyed by the twisting.

The sound of some trumpet mouthpieces can be changed by using different weights (heavyweight, lightweight model, etc.). However, this is still a perceptible change to the musician. Even different mouthpieces of the same brand and model can have a different feel to a musician. Some mouthpieces have weights that can be added to them. A brass ring, for example, can be put on top of the backbore with some models of mouthpieces. This adds some flexibility but still does not provide enough material to work with, especially when one uses materials other than brass. One can change the main intonation just with the main slide. There is no way to change that on the mouthpiece. In some extreme cases (such as if the ambient air is cold or if the musician must tune to an out-of-tune piano), it is helpful to have more flexibility.

OBJECTS AND SUMMARY OF THE INVENTION

It is therefore an object of this invention to provide a mouthpiece which has an internal passageway or bore with a smooth transition, substantially free of discontinuities, to the leadpipe of the brass instrument.

It is therefore a further object of this invention to provide a mouthpiece for a brass instrument which can have an internal passageway substantially free of discontinuities, and into which discontinuities can be variable introduced.

It is therefore a further object of this invention to eliminate the radial gap between the mouthpiece and the instrument.

It is therefore a further object of this invention to provide improved air resistance and tonality to brass instruments.

It is therefore a further object of this invention to provide a way to vary the tone of a brass instrument.

It is therefore a further object of this invention to provide a mouthpiece system which does not become difficult to remove from the leadpipe.

It is therefore a further object of this invention to provide a mouthpiece for brass instruments in which certain characteristics of the mouthpiece can be varied while other characteristics are maintained.

It is therefore a further object of this invention to provide a mouthpiece for brass instruments which allows the musician to experiment with different tonalities and configurations.

It is therefore a further object of the invention to provide the brass player with a systematic system to make it simple to custom fit mouthpieces. By changing one piece at a time, the player can focus on one particular quality and compare the changes.

These and other objects are attained by the invention by providing a mouthpiece assembly for a brass instrument which is screwed into the leadpipe and provides an internal passageway or bore which is substantially free of discontinuities to the leadpipe of the brass instrument. The first part of the leadpipe (i.e., the shank) and the mouthpiece is one integral piece. A thread is soldered to the leadpipe with a counterthread. An internal thread is formed on the shank and an external thread is formed on the leadpipe. The diameter of the internal passageway or bore of the mouthpiece is matched to the diameter of the internal passageway of the leadpipe at the transition between the mouthpiece and leadpipe. Therefore, there is no gap, discontinuity or rapid transition in the diameter in the internal passageways or bores of the mouthpiece and the leadpipe. Therefore, an essentially perfect bore is achieved with no disturbance in airflow. The result is a lower resistance to air flow, a fuller, bigger sound, an improved feel of the instrument and better intonation. This can be used on all brass instruments. To achieve best results with a trombone or a flugelhorn, which have inside leadpipes, the mouthpiece and inner leadpipes can be made of one piece or be screwed on the inner leadpipe as described before. Additionally, by not screwing in the mouthpiece completely onto the leadpipe, a gap can be optionally and variably formed, and the air flow resistance can be increased. This allows a musician to use the same mouthpiece for different musical styles (such as classical, which, as described before, requires an increased flow resistance and reduced volume).

Additionally, as the mouthpiece assembly includes several pieces, various pieces can be interchanged to vary the characteristics of the mouthpiece while retaining other pieces thereby maintaining other characteristics of the mouthpiece. By the use of a removable casing of different materials and/or different shapes for the middle part of the mouthpiece, the sound can be changed dramatically. This can be done without changing the feel for the player as the rim, cup and/or backbore can stay the same. It is therefore very easy to adapt to a new playing style without having to adapt to the feel of a new mouthpiece. Additionally, this variable middle portion can be used on a regular mouthpiece backbore with a cone to fit it into a regular leadpipe. The rim and cup, along with the middle portion, is variable when used with a regular mouthpiece style backbore. The cup can be detached and at the beginning of the middle part can be easily put on the backbore and fixed by attaching the cup back on. Unlike other systems, it gives one the entire length of the mouthpiece to work with and on a regular one, a musician can put it anywhere along the mouthpiece except where the outside cone of the backbore is. The outside part where the casing is fitted is cylindrical. This gives the musician further possibilities in changing the sound or even achieving sound effects. For example, if the middle casing is not tightly fitted, it could vibrate with the sound a create an unconventional sound.

If the mouthpiece system is screwed to the fullest extent onto the leadpipe, the intonation becomes sharper. Likewise, if the mouthpiece system is screwed to a lesser extent onto the leadpipe, the intonation becomes flatter. Normally, the main slide gives the musician enough room for adjusting the general intonation.

Additionally, the screw attachments of the mouthpiece of the present invention are less likely to become difficult to remove from the leadpipe of the brass instrument.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 2:
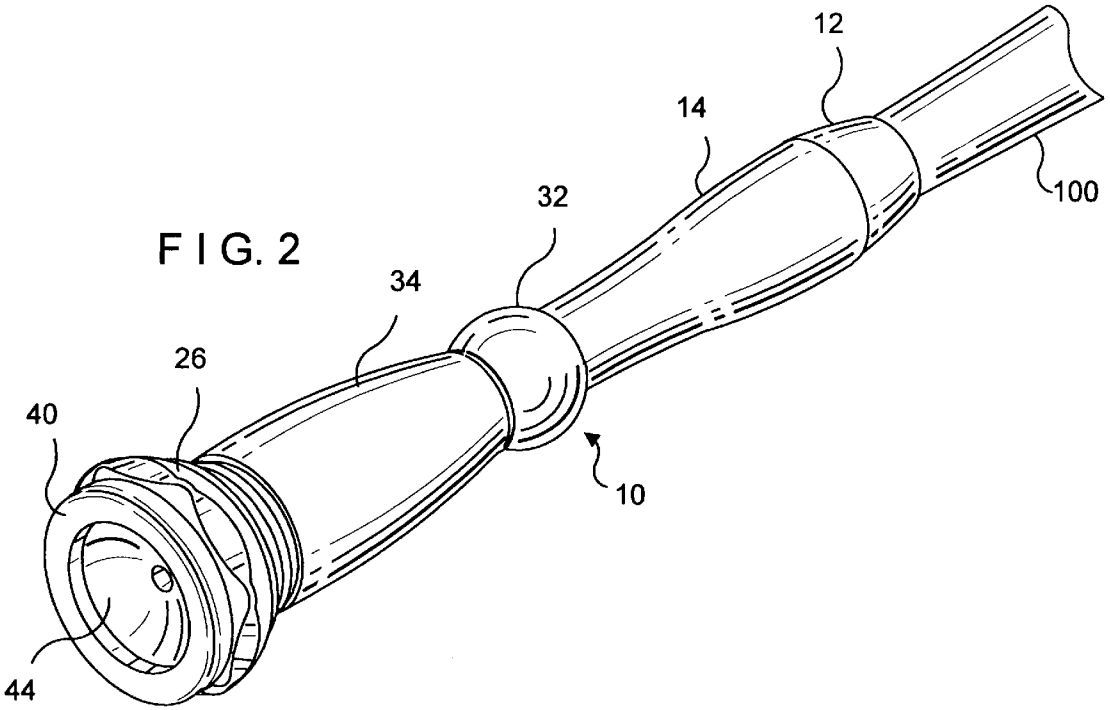
FIG. 2 is a perspective view of the mouthpiece system of the present invention.
Figure 1:
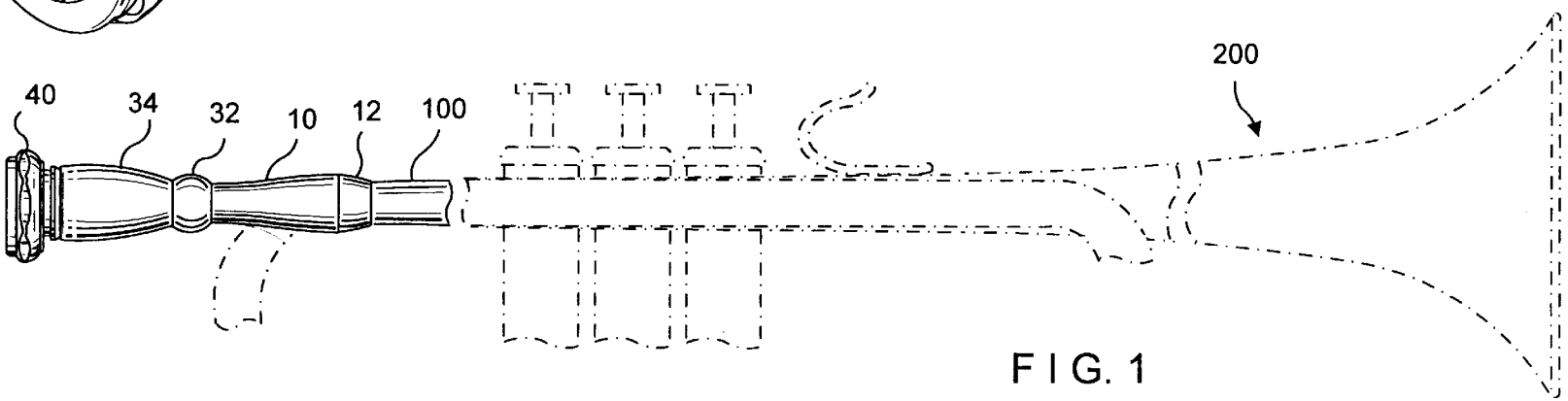
FIG. 1 is a side plan view of the mouthpiece system of the present invention with a trumpet shown in phantom.

Referring now to the drawings in detail wherein like numerals indicate like elements throughout the several views, one sees that FIG. 1 is a perspective view of mouthpiece assembly 10 as it attaches to leadpipe 100 of brass instrument 200 (shown in phantom in FIG. 2).

Figure 3:
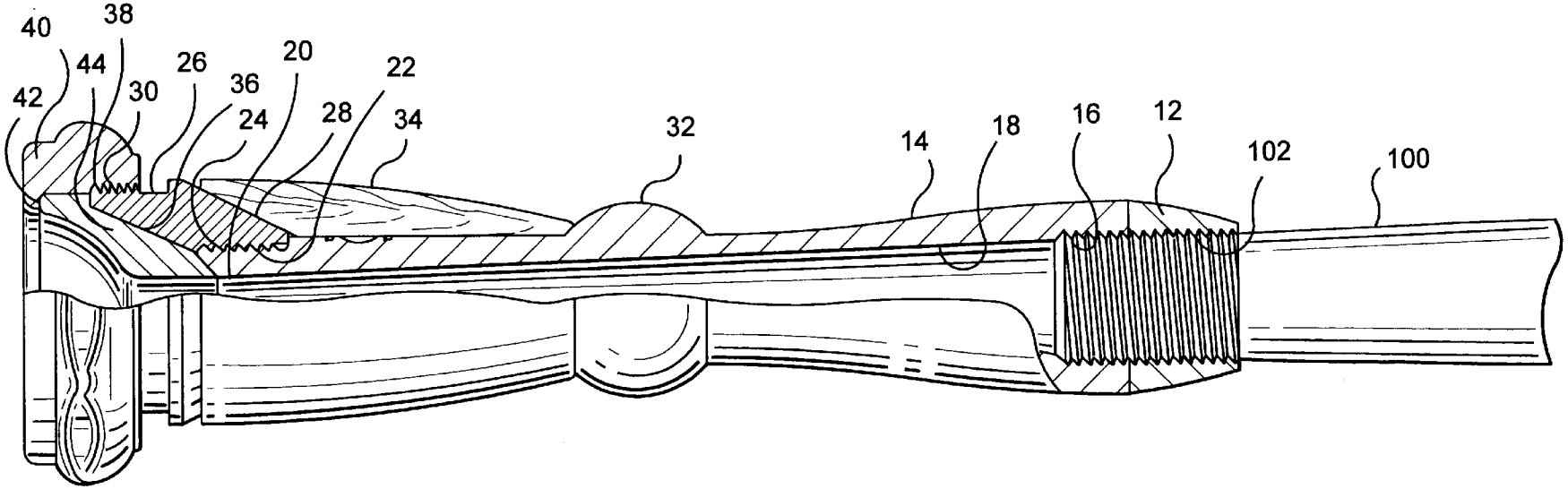
FIG. 3 is a side view, partially in cross section, of the mouthpiece system of the present invention.
Figure 4:
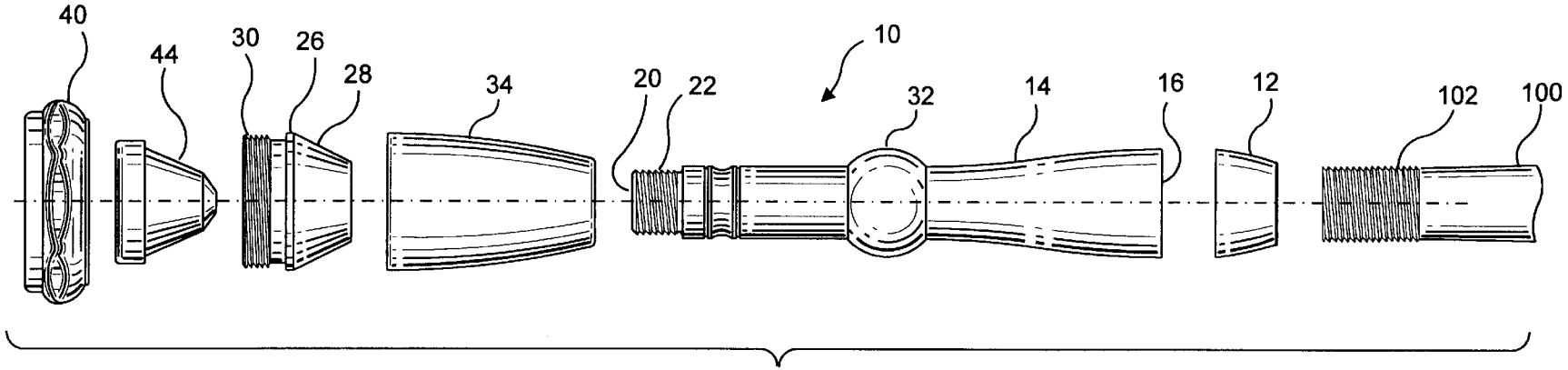
FIG. 4 is an exploded view of the mouthpiece system of the present invention.

As shown in FIGS. 3 and 4, in which all of the illustrated elements are substantially rotationally symmetric, leadpipe 100 includes external threads 102 onto which cylindrical spacer 12 is threadedly attached. The axial position of cylindrical spacer 12 is chosen by the musician to provide the desired stopping point for the position of the stem 14 which likewise includes an internally threaded portion at the proximal end 16 thereof. The internal axial passageway 18 of stem 14 is preferably conically shaped with a lesser diameter at its distal end 20 and a greater diameter at its proximal end 16. The greater diameter of the internal axial passageway 18 at the proximal end 16 of stem 14 is matched with the diameter of the internal passageway of the leadpipe 100 thereby achieving a transition between the internal passageways of the mouthpiece assembly 10 and the leadpipe 100 which is substantially free of discontinuities. Alternatively, when desired, the musician can adjust the extent of the screw attachment of the spacer 12 and the stem 14 onto the leadpipe 10 to create a gap or discontinuity in the transition between the internal passageways of the mouthpiece assembly 10 and the leadpipe 100. This increases the airflow resistance of the brass instrument 200 and typically reduces its volume as would be required for classical music applications.

Distal end 20 of stem 14 likewise includes external threads 22 which engage the internal threads 24 of cup holder 26. Cup holder 26 further includes forwardly pointed oblique conical walls 28 and rearwardly pointed external threads 30. Stem 14 includes an exterior central bulbous portion 32. When cup holder 26 is threaded attached to stem 14, weight attachment 34 is secured between the forwardly pointed oblique conical walls 28 of cup holder 26 and exterior central bulbous portion 32.

Cup holder 26 further includes rearwardly pointed oblique conical walls 36 inwardly radially adjacent from rearwardly pointed external threads 30. Rearwardly pointed external threads 30 of cupholder 26 engage the forward internal threads 38 of rim 40. Rim 40 further includes an inwardly extending circumferential ledge 42 which engages cup 44 against rearwardly pointed oblique conical walls 26 of cup holder 26.

The configuration illustrated in FIGS. 1–4 allows the musician to interchange various pieces, such as stem 14, weight attachment 34 and/or cupholder 26 so as to vary the tone of the instrument while maintaining other pieces, such as cup 44 and rim 40 so as to maintain the feel of the instrument 200 against the musician's lips. However, cup 44 and rim 40 may be similarly interchanged for different desired effects.

Figure 5:
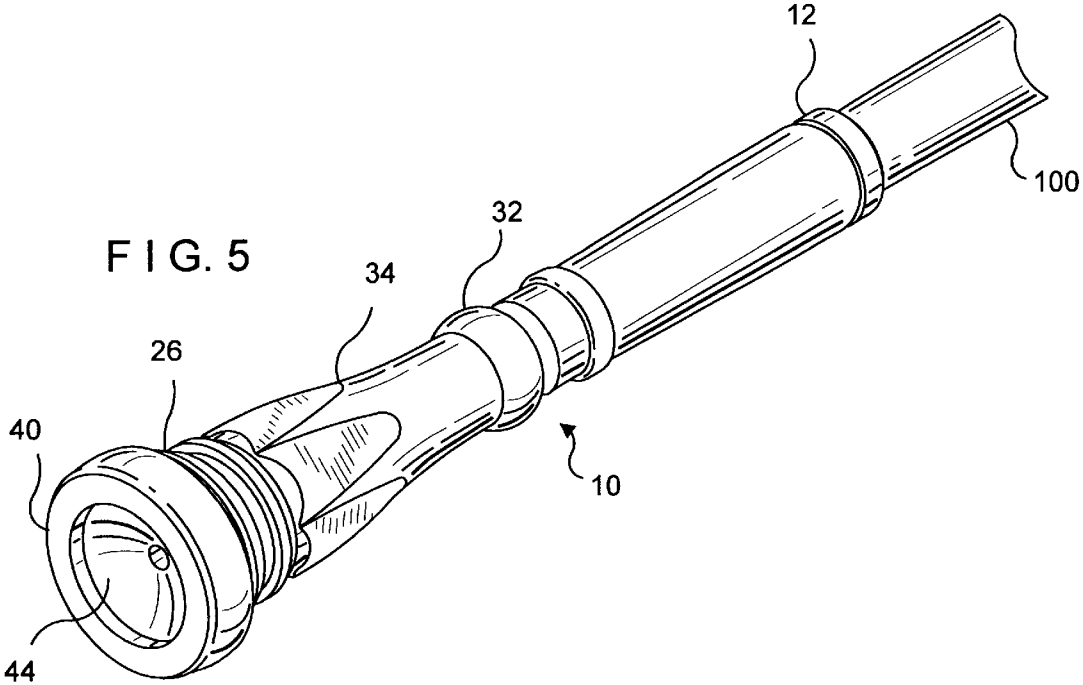
FIG. 5 is a perspective view of an alternate embodiment of the mouthpiece system of the present invention.
Figure 6:
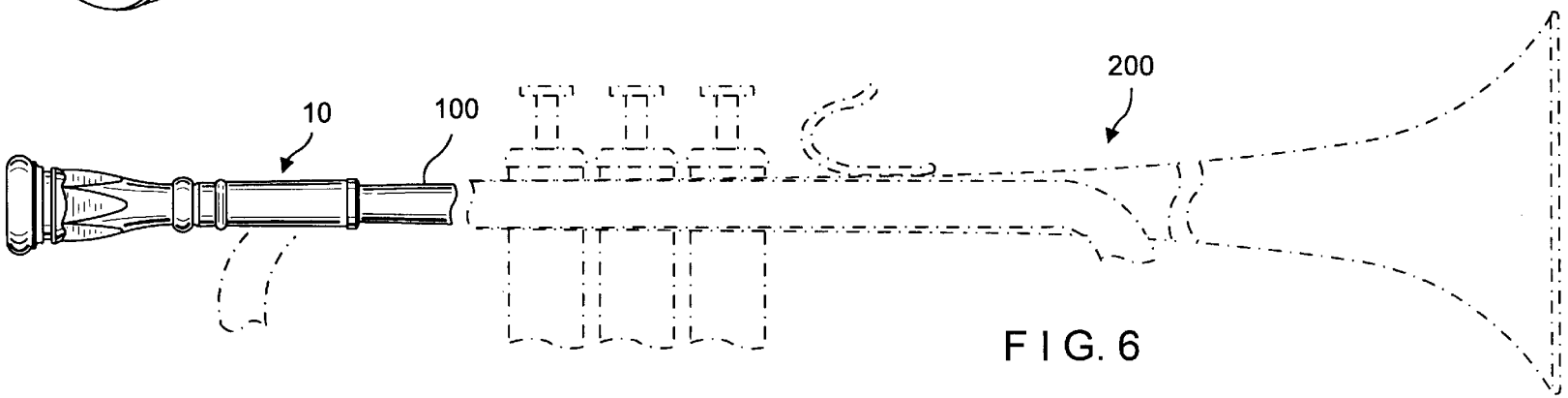
FIG. 6 is a side plan view of an alternate embodiment of the mouthpiece system of the present invention with a trumpet shown in phantom.
Figure 7:
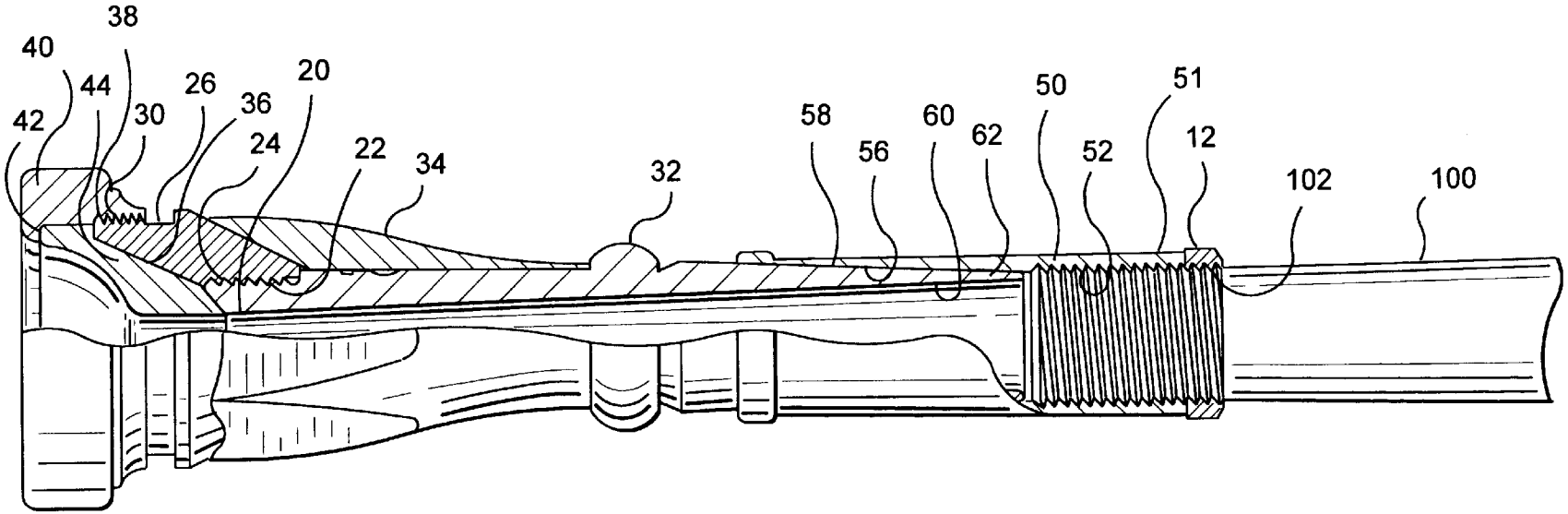
FIG. 7 is a side view, partially in cross section, of an alternate embodiment of the mouthpiece system of the present invention.

FIGS. 5–8 illustrate an alternative embodiment of the mouthpiece assembly 10. FIG. 5 illustrates a perspective view of the assembled mouthpiece assembly 10. FIG. 6 illustrates the mouthpiece assembly 10 in relation to the brass instrument 200, shown in phantom. FIG. 7 is a side view, partially in cross section, of the assembled mouthpiece assembly 10.

Referring now to FIG. 8, where again, all elements are substantially rotationally symmetric, one sees an exploded view of the mouthpiece assembly 10 of the alternate embodiment.

Leadpipe 100 includes external threads 102 which engage spacer 12. The proximal end 51 of leadpipe extension 50 includes internal threads 52 to engage external threads 102. Spacer 12 acts as a stop to determine the final position of lead pipe extension 50.

The distal end 54 of lead pipe extension includes internal oblique conical walls 56 which taper inwardly to meet internal threads 52 extending from proximal end 51. Internal oblique conical walls 56 frictionally engage the external oblique conical walls 58 of stem 14. While this engagement may appear similar to the typical engagement of a mouthpiece to a leadpipe, it is very different in two respects. Firstly, the internal oblique conical walls 56 of leadpipe extension 50 are complementary to the external oblique conical walls 58 of stem 14. This permits engagement without a radial (i.e., doughnut shaped) gap between the mouthpiece and the leadpipe. Secondly, the diameter of the internal passageway 60 of the forward end 62 of stem 14 is matched to the diameter of the internal passageway of leadpipe 100.

Figure 8:
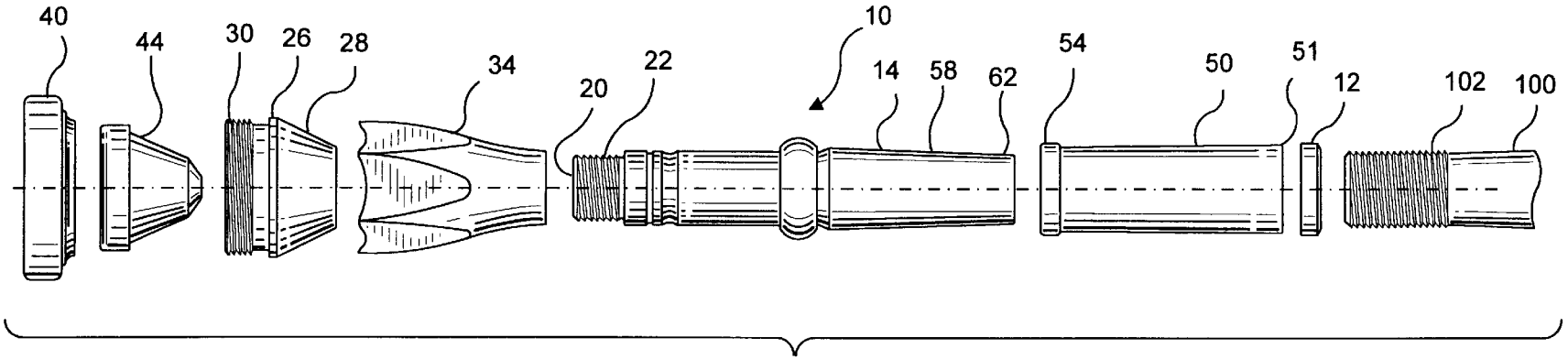
FIG. 8 is an exploded view of an alternate embodiment of the mouthpiece system of the present invention.

The modular configuration of FIG. 8 can be used with or without the aspects illustrated in FIGS. 1–7.

The exterior central bulbous portion 32 of stem 14 and the elements rearward thereof are substantially similar to those illustrated in FIGS. 1–4.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A mouthpiece assembly for a brass instrument including:

a cup for engaging a musician's lips;

a cup holder for holding said cup, said cup holder being a separate element from said cup;

a body portion including a rearward end engaging said cup holder, and a forward end for engaging a leadpipe of the brass instrument;

said body portion including a central aperture passing therethrough, the central aperture including thread means at said forward end for engaging a complementary thread means on the leadpipe of the brass instrument;

a spacer threaded to said complementary thread means to abut said extension and to limit a position of said extension on said complementary thread means; and said central aperture having a diameter at said forward end matching a diameter of an internal aperture of the leadpipe of the brass instrument.

2. The mouthpiece assembly of claim 1 wherein said thread means is an internal thread and said complementary thread means is an external thread.

3. The mouthpiece assembly of claim 2 wherein said body portion includes a stem which threadedly engages a cup holder.

4. The mouthpiece assembly of claim 3 wherein said cup holder threaded engages a rim.

5. The mouthpiece assembly of claim 4 wherein said cup holder engages a weight attachment against an exterior central bulbous portion of said stem.

6. The mouthpiece assembly of claim 5 wherein said rim includes an inwardly extending ledge which engages said cup portion which is further engaged by said cup holder.

7. The mouthpiece assembly of claim 6 wherein said stem, said weight attachment, said cup holder, said cup portion and said rim are provided in a plurality of said elements, each of said plurality being interchangeable.

8. A mouthpiece assembly for a brass instrument including:

an extension with a forward portion and a rearward portion, said forward portion including thread means for engaging a complementary thread means on a leadpipe of the brass instrument;

a spacer threaded to said complementary thread means to abut said extension and to limit a position of said extension on said complementary thread means;

a cup for engaging a musician's lips;

a cup holder for holding said cup, said cup holder being a separate element from said cup;

a body portion including a central aperture passing therethrough, and further including a rearward end engaging said cup portion, and a forward end for frictionally engaging said rearward portion of said extension;

said central aperture having a diameter at said forward end matching a diameter of an internal aperture of the leadpipe of the brass instrument.

9. The mouthpiece assembly of claim 8 wherein said forward end of said body portion engages said rearward portion of said extension substantially free of a radial gap therebetween.

10. The mouthpiece assembly of claim 9 wherein said forward end of said body portion includes an external oblique conical wall which is substantially complementary to an internal oblique conical wall formed in said rearwardly end of said extension.

11. The mouthpiece assembly of claim 10 wherein said forward end of said body portion abuts said leadpipe within said extension.

12. The mouthpiece assembly of claim 11 wherein said thread means is an internal thread and said complementary thread means is an external thread.

13. The mouthpiece assembly of claim 12 wherein said body portion includes a stem which threadedly engages a cup holder.

14. The mouthpiece assembly of claim 13 wherein said cup holder threadably engages a rim.

15. The mouthpiece assembly of claim 14 wherein said cup holder engages a weight attachment against an exterior central bulbous portion of said stem.

16. The mouthpiece assembly of claim 15 wherein said rim includes an inwardly extending ledge which engages a cup which is further engaged by said cup holder.

17. The mouthpiece assembly of claim 16 wherein said stem, said weight attachment, said cup holder, said cup and said rim are provided in a plurality of said elements, each of said plurality being interchangeable.

* * * * *